US007464743B1

(12) United States Patent
Berger, Jr.

(10) Patent No.: US 7,464,743 B1
(45) Date of Patent: Dec. 16, 2008

(54) ROLL FORMED ROLL-UP DOOR GUIDE WITH DOUBLE WIND BAR END

(76) Inventor: Allen Berger, Jr., 12195 NW. 98 Ave., Hialeah Gardens, FL (US) 33018

( * ) Notice: Subject to any disclaimer, the term of this patent is extended or adjusted under 35 U.S.C. 154(b) by 457 days.

(21) Appl. No.: 11/255,631

(22) Filed: Oct. 24, 2005

(51) Int. Cl.
*A47G 5/02* (2006.01)

(52) U.S. Cl. ..... 160/273.1; 160/133; 160/903; 160/235; 160/290.1

(58) Field of Classification Search ..... 160/133, 160/903, 273.1, 290.1, 41, 235
See application file for complete search history.

(56) References Cited

U.S. PATENT DOCUMENTS 1,918,415 A * 7/1933 Miller ..... 160/23.1
3,076,499 A * 2/1963 Zoll et al. ..... 160/41
5,351,742 A * 10/1994 Lichy ..... 160/273.1
5,377,738 A * 1/1995 Cooper ..... 160/133
5,477,902 A * 12/1995 Kraeutler ..... 160/84.06
5,657,805 A * 8/1997 Magro ..... 160/133
6,065,525 A * 5/2000 Wells ..... 160/273.1
6,068,040 A * 5/2000 Magro et al. ..... 160/133
6,260,601 B1 * 7/2001 Thomas ..... 160/133
2004/0020609 A1 * 2/2004 Savard et al. ..... 160/133

* cited by examiner

*Primary Examiner*—Katherine W Mitchell
*Assistant Examiner*—James F Cardenas-Garcia
(74) *Attorney, Agent, or Firm*—Sanchelima & Assoc., P.A.

(57) ABSTRACT

A mechanism for guiding roll up doors made from a foldable sheet. A longitudinally extending wall of the foldable sheet is secured to a fixed structure and two longitudinally extending lateral walls extend perpendicularly to form another two reversible folds resulting in two longitudinally extending inner walls at a spaced apart and parallel relationship with the two lateral walls. From one of these inner walls, a longitudinal wind bar extends at a predetermined cooperative angle. Upon the application of a wind load to the door slats, the load is transmitted to the foldable sheet guiding assembly from the slats directly and through the wind lock assembly through at least four contact points. The laterally articulated door slats include longitudinal hook portions or wind lock assemblies that slidably coact with the wind bar to keep the slat in place.

5 Claims, 4 Drawing Sheets

Fig 1
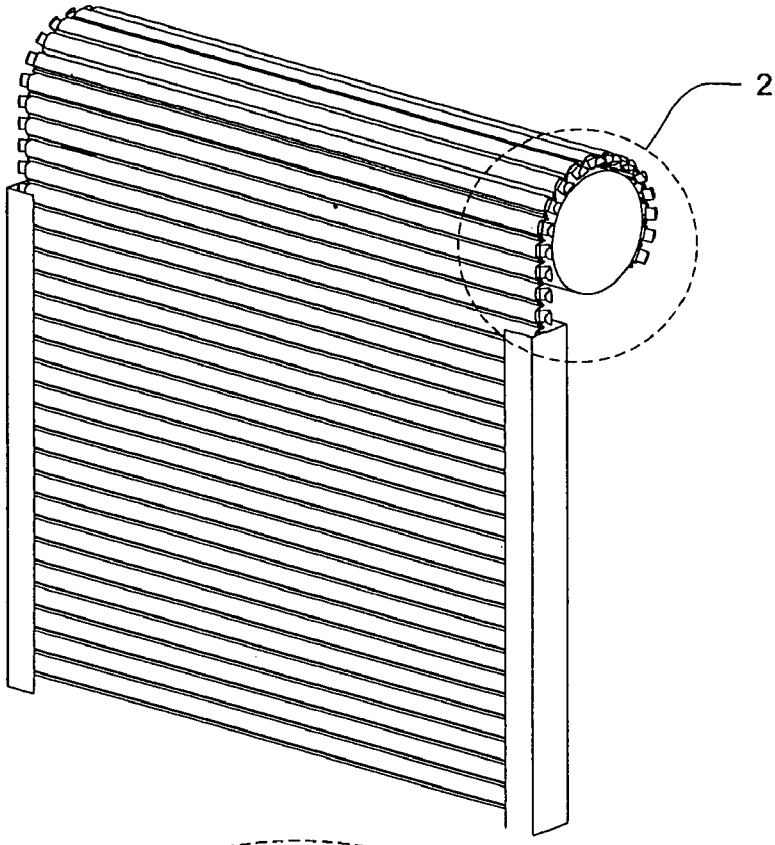
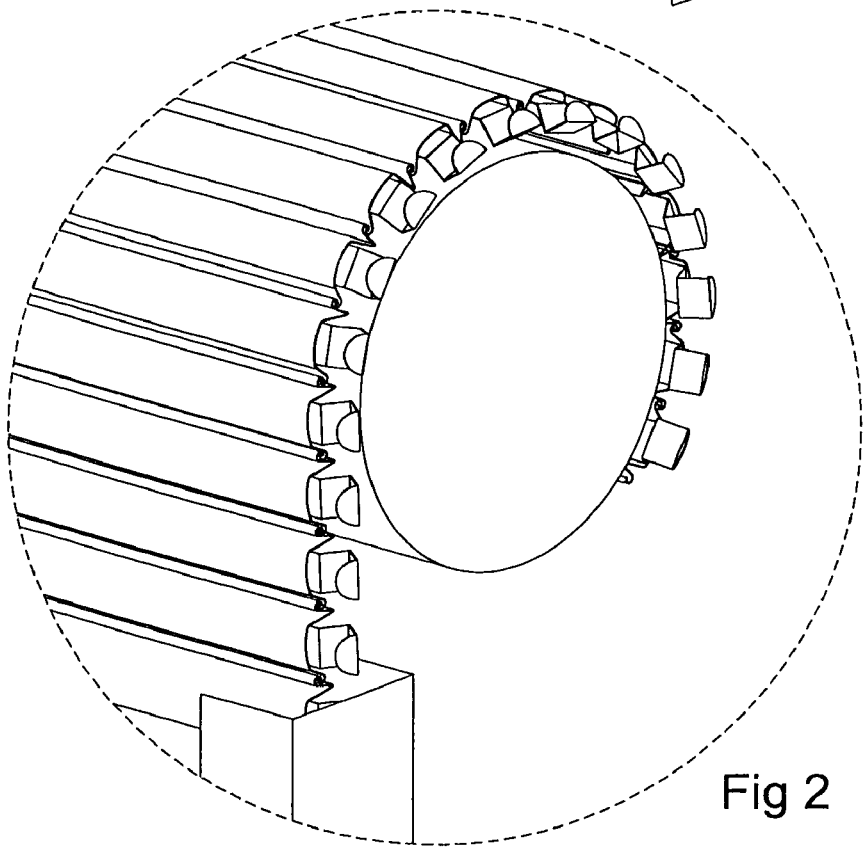
Fig 2

ROLL FORMED ROLL-UP DOOR GUIDE WITH DOUBLE WIND BAR END

BACKGROUND OF THE INVENTION

1. Field of the Invention

The present invention relates to a roll formed roll-up door guide and built-in double wind bar mechanism.

2. Description of the Related Art

Several designs for roll-up door guides have been designed in the past. None of them, however, are made from a foldable sheet compatible with roll forming manufacturing methods with the consequent cost savings. The door guides in the past required the use of secondary operations to make them hurricane resistant. In addition to being very costly, the guiding mechanisms of the prior art failed to withstand the wind loads required by the competent authorities. Most of the time, the wind load is concentrated in one contact point (the wind lock assembly) causing the latter to break.

One of the door guides of the related prior art is described in U.S. Pat. No. 6,068,040 issued to Magro, et al. on May 30, 2000 for a slat edge retainer for overhead rolling doors. Magro's patented invention relates to wind-resistant overhead rolling doors with a retainer for securing the edges of the slat including an edge retainer for a slat of an overhead rolling door. It includes a plurality slats, each defining a slat plane with two opposing substantially parallel longitudinal edges in the lateral edge at each longitudinal end. The retainer includes first and second members having mounting portions at the lateral edge of the slat and are secured to opposite surfaces of the slat to receive at least a portion of the lateral edge sandwiched there between. An end lock is integrally formed with one of the mounting portions and extends from one side of the slat to the other side of the slat. A wind lock is integrally formed with the other mounting portion and extends from the other side thereof to the first side of the slat. However, it differs from the present invention because, inter alia, the door guide and wind bar are implemented using several components requiring numerous secondary operations. More important, the combination and interaction of the elements in the present invention provide more points of support upon the application of positive and negative wind forces, such as those generated by hurricanes.

Another reference corresponds to U.S. Pat. No. 5,657,805 issued to Magro on Aug. 19, 1997 for a wind-resistant overhead closure. Magro's patented invention relates to closures for openings in building structures, which are wind-resistant, such as a wind-resistant overhead door including windbars mounted on the side portions of the frame, and windlocks or endlocks on the lateral edge portions of the intermediate and bottommost of endmost slats of the closure, such as a rolling door.

Still another reference corresponds to U.S. Pat. No. 6,065,535 issued to David A. Wells for a roll up assembly that includes a wind lock 56 in the flange 60 that engages with hook portion 64. However, wind lock 56 is a discrete component that is mounted to guiding tracks 14 and 16. In the present invention, roll-formed guiding member 20 is integrally built and implements also the wind lock 30. Furthermore, guiding wall 28 and 29 in the present invention provide considerable more guiding area and better locking action between wind lock 30 and hook portion 43.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a roll-up door guide mechanism that can be produced using relatively inexpensive roll-forming manufacturing processes on a continuous foldable sheet.

It is another object of this invention to provide a roll-up door guide mechanism that can withstand substantial wind forces.

It is another object of this invention to provide such a roll-up door guide mechanism that is easy to install.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an isometric view of a roll-up door using a roll-up door guide mechanism incorporating the present invention.

FIG. 2 is an enlarged representation of the encircled portion in FIG. 1.

DETAILED DESCRIPTION OF THE PREFERRED EMBODIMENT

The present invention is an improvement for overhead rolling doors like the one represented in FIG. 1. Hingedly mounted panels 60, like the two represented in FIG. 2, differ in number and dimension to protect desired openings. Door slats 60 are contiguously articulated as shown in FIGS. 1 and 2.

Figure 3:
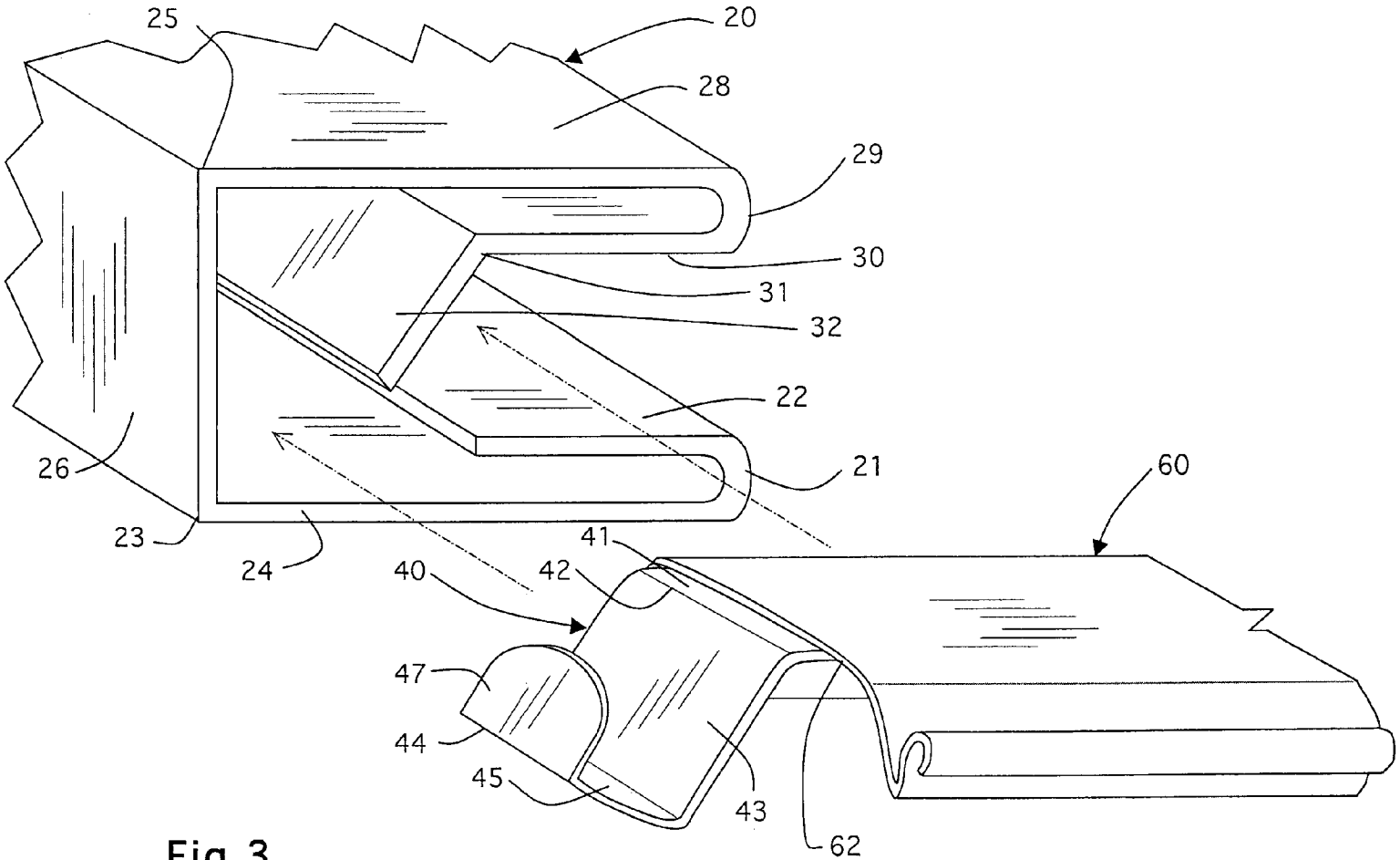
FIG. 3 is an enlarged isometric illustration of a door guide and wind lock assembly.
Figure 4:
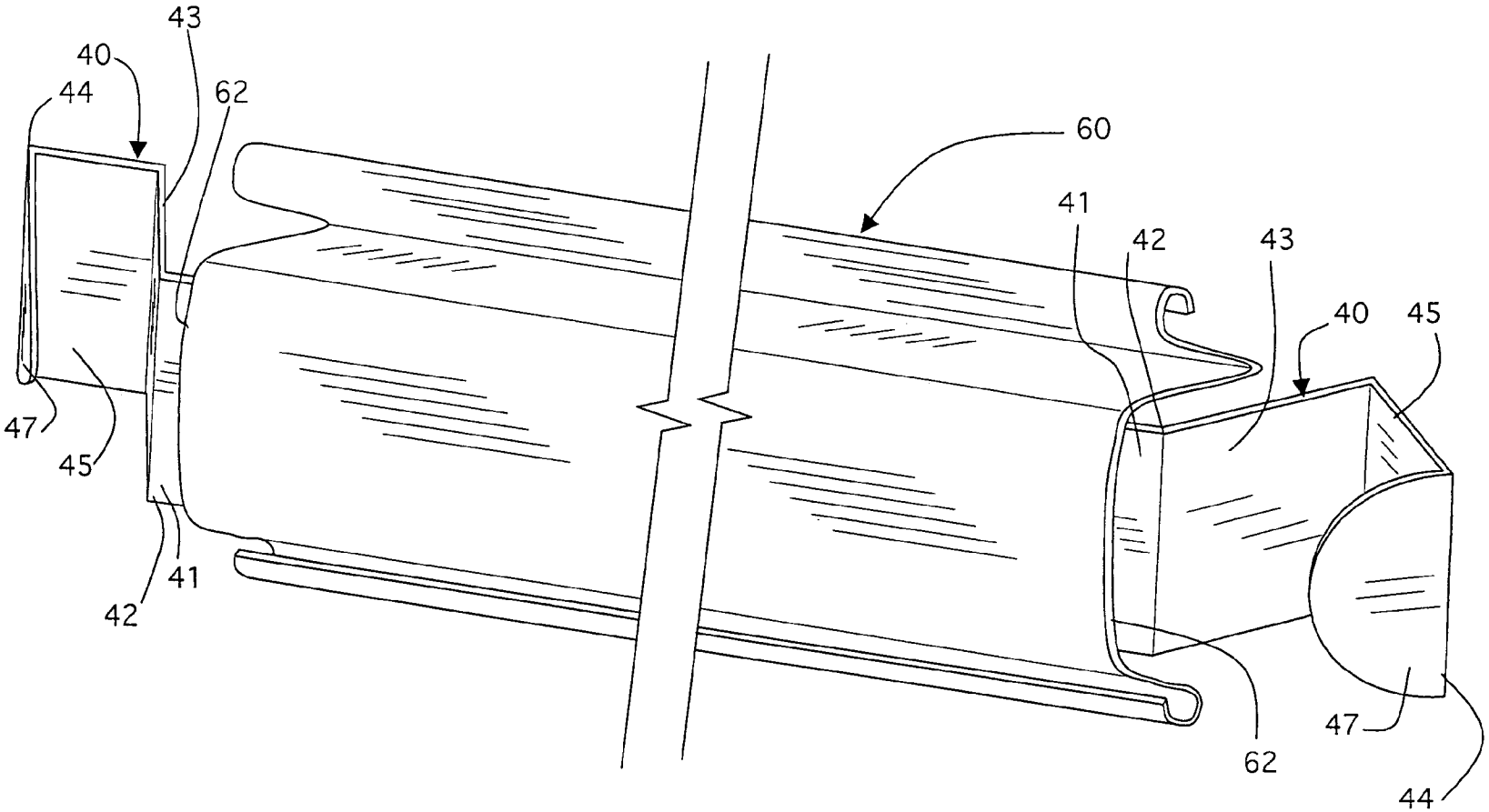
FIG. 4 is an isometric view of a broken slat showing both ends.
Figure 5A:
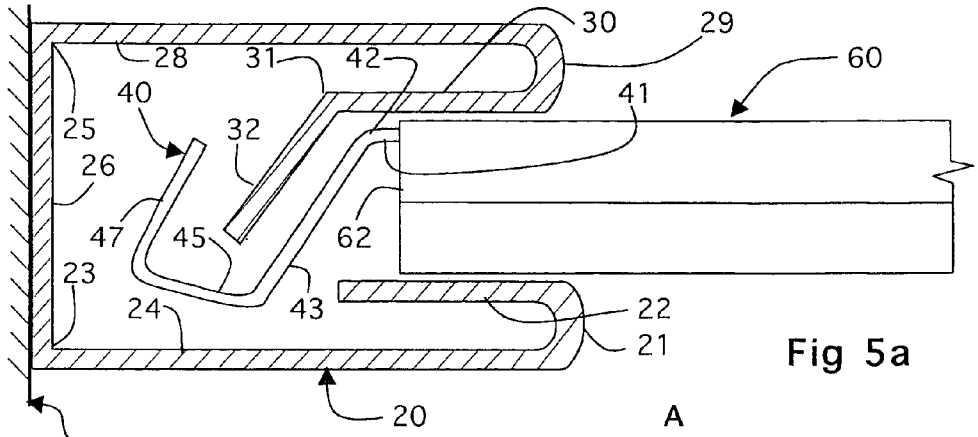
FIG. 5*a* shows a partial cross-sectional view of a door slat with the wind lock assembly mounted thereon and protruding from its end and coacting with a door guide's wind bar incorporating one of the preferred embodiments for the present invention.

Referring now to the drawings, where the present invention is generally referred to with numeral 10, it can be observed that it basically includes roll-formed longitudinal guide assembly 20 and wind lock member 40 mounted to door slat 60 and extending from end 62, as seen in FIGS. 5*a;* 5*b* and 5*c*. Guiding assembly 20 includes longitudinal wall 26 that is rigidly mounted to structure S. Perpendicularly disposed elongated walls 24 and 28 extend from ends 23 and 25 of wall 26, respectively. Folds 21 and 29 form inwardly extending guiding walls 22 and 30 that are disposed at a parallel relationship with respect to walls 24 and 28, respectively. Longitudinally extending wind bar 32 extends from wall 30 at bend 31 and at a predetermined angular disposition with respect to wall 30. This angular disposition corresponds to an obtuse angle with respect to wall 30, as best seen in FIG. 3. It has been found that angles between 90 and 160 degrees work well.

FIGS. 5*a;* 5*b* and 5*c* partially show slat 60 with wind lock assembly 40 has wall 41 that extends outwardly from end 62 of slat 60. Wind lock assembly includes walls 43; 45 and 47 resembling a C-shaped hook. Wall 41 includes bend 42 and wall 43 extends therefore at an obtuse angle, as shown in FIG. 3. This obtuse angle of wall 43 also cooperates with the angle of wind bar 32 to ensure that the latter is sufficiently housed within lock assembly 40. The slidable engagement of wind bar 32 within wind lock assembly 40 guides slat 60 along a predetermined path.

Figure 5B:
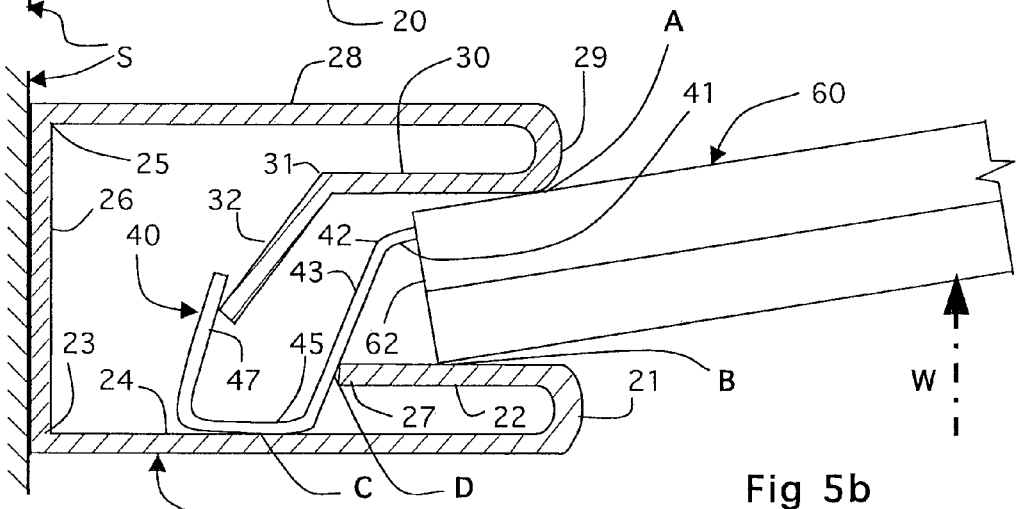
FIG. 5*b* shows a partial cross-sectional view of a door slat with the wind lock bar mounted at its edge and coacting with a door guide of the embodiment represented in FIG. 5*a,* when the door is being exposed to wind load in one direction.

In FIG. 5*b,* the partial cross-section of the end of a slat shown in FIG. 5*a* is shown with wind load W acting on it. Contact points A, B, C, and D provide the necessary support to lock slat 60 in place, preventing it from being dislodged. The locking action is provided by slat 60 coming in contact with fold 29 (at contact point A) and wall 22 (at support points), respectively, and also by wall 45 coacting against wall 24 (at contact point C) and wall 43 against end 27 (at contact point D).

Figure 5C:
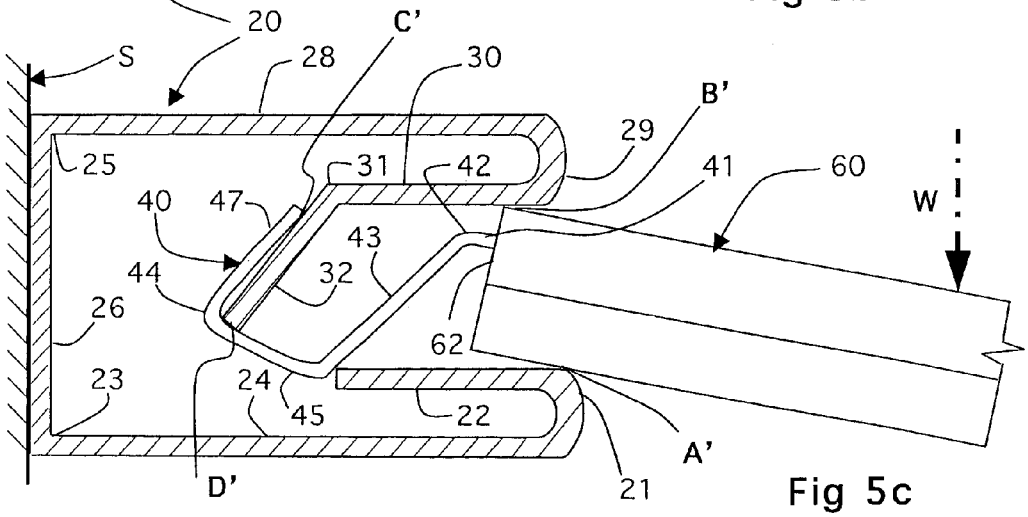
FIG. 5*c* shows a partial cross-sectional view of a door slat with the wind lock bar mounted at one of its end edges and coacting with a longitudinal guide member of the embodiment represented in FIG. 5*a,* when the door is being exposed to a wind load in opposite direction to the one shown in FIG. 5*b.*

In FIG. 5*c,* support contact points A', B', C' and D' are shown when wind load W is applied in the opposite direction. Slat 60 comes in contact with fold 21 (at support point A') and with wall 30 (at support contact point B). The end of wall 47 comes in contact with wall 32 (at contact point C). Inner side of bend 44 of wind lock assembly 40 coacts with the end of longitudinally extending wind bar 32 (at support point D'). These support points prevent the separation of door slat 60 when wind loads are applied.

The resulting mechanisms are particularly suitable for production using inexpensive roll-forming processes. The cost advantages are quite apparent as well as an increase in their reliability. The wind loads are transmitted from door slat 60, directly, or indirectly, though wind lock assembly 40, to guide assembly 20 and subsequently to structures S'. The different contact points result in a mechanism that enhances its resistance to wind loads.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A guiding mechanism for roll-up doors, comprising:

A) two roll-formed elongated guiding members (20) each having a longitudinally extending first wall (26) rigidly and vertically mounted to fixed structures at parallel and spaced locations, integrally formed longitudinal second and third walls (28; 24) kept at a parallel spaced apart relationship extending from said first wall (26) and being substantially perpendicular with respect to said first wall, integrally formed longitudinal fourth and fifth walls (30; 22) extending from said second and third walls (28; 24), and said longitudinally extending fourth and fifth walls (30; 22) being folded at a parallel and spaced apart relationship with said second and third walls (28; 24), respectively, and extending towards said longitudinally extending first wall (26) a first predetermined distance, a longitudinally extending sixth wall (32) extending from a fold at said fourth wall (30) at a predetermined angle with respect to said fourth wall (30); and B) a plurality of door slats each including two ends and two lateral articulated edges, each of said ends including an elongated wind lock assembly (40) mounted thereon, said wind lock assembly (40) including a first wind lock wall (41) axially and outwardly extending from said slat, including a first bend (42), a second wind lock wall (43) extending from said first bend (42) and said second wind lock wall (43) being disposed at a first predetermined obtuse angle with respect to said first wind lock wall (41), a third wind lock wall (45) extending substantially perpendicularly from said second wind lock wall (43) and a fourth wind lock wall (47) extending substantially perpendicular from said third wind lock wall (45) thereby forming a C-shape hook for slidably and partially housing said longitudinally extending sixth wall (32) of said guiding members (20) thereby keeping said slat slidably in place over a predetermined path.

2. The mechanism set forth in claim 1 wherein said predetermined angle of said longitudinally extending sixth wall (32) is between 90 and 160 degrees with respect to said longitudinally extending fourth wall (30) of said elongated guiding member (20).

3. The mechanism set forth in claim 2 wherein, upon the application of a wind load, said door slat comes in contact with said longitudinally extending fourth and fifth walls (30; 22) and said longitudinally extending sixth wall (32) comes in contact with said wind lock assembly (40) thereby transmitting said wind load to said fixed structure through at least four support contact points (A, B, C, D or A', B', C', D').

4. The mechanism set forth in claim 3 wherein said sixth wall (32) engages with the interior of said wind lock assembly (40), said door slat co-acts with said fourth and fifth walls (30; 22) and said wind lock assembly (40) co-acts with said sixth wall (32) when the wind load is exerted on said door slats (60) in one direction thereby transmitting said wind load to said fixed structure through at least four support contact points (A', B', C', and D').

5. The mechanism set forth in claim 3 wherein said sixth wall (32) engages with the interior of said wind lock assembly (40), said door slat co-acts with said fourth and fifth walls (30; 22) and said wind lock assembly (40) co-acts with said second wall (24) when the wind lead is exerted on door slats (60) in another direction thereby transmitting said wind load to said fixed structure through at least four support contact points (A, B, C, and D).

* * * * *